US011098515B2

(12) United States Patent
Giovannetti

(10) Patent No.: US 11,098,515 B2
(45) Date of Patent: Aug. 24, 2021

(54) AUTOMATIC OPENING MECHANISM FOR FLAP DOORS

(71) Applicant: EFFEGI BREVETTI S.R.L., Segrate (IT)

(72) Inventor: Antonio Giovannetti, Segrate (IT)

(73) Assignee: EFFEGI BREVETTI S.R.L., Segrate (IT)

( * ) Notice: Subject to any disclaimer, the term of this patent is extended or adjusted under 35 U.S.C. 154(b) by 3 days.

(21) Appl. No.: 16/753,851

(22) PCT Filed: Sep. 21, 2018

(86) PCT No.: PCT/EP2018/075668
§ 371 (c)(1),
(2) Date: Apr. 6, 2020

(87) PCT Pub. No.: WO2019/068491
PCT Pub. Date: Apr. 11, 2019

(65) Prior Publication Data

US 2020/0340278 A1 Oct. 29, 2020

(30) Foreign Application Priority Data

Oct. 6, 2017 (IT) ..... 102017000112315

(51) Int. Cl.
*E05F 1/08* (2006.01)
*E05F 1/10* (2006.01)

(52) U.S. Cl.
CPC ..... *E05F 1/105* (2013.01); *E05F 1/1066* (2013.01); *E05Y 2201/722* (2013.01); *E05Y 2800/122* (2013.01); *E05Y 2900/20* (2013.01)

(58) Field of Classification Search
CPC ... E05F 1/08; E05F 1/10; E05F 1/1041; E05F 1/105; E05F 1/1058; E05F 1/1066; E05F 1/1075; E05F 1/1091; E05F 1/12; E05F 1/1223; E05F 1/1246; E05F 1/1253; E05F 1/1261; E05F 1/1292; E05F 1/14;
(Continued)

(56) References Cited

U.S. PATENT DOCUMENTS 2,626,420 A * 1/1953 Mongin ..... E05F 1/1269 16/79
3,088,727 A * 5/1963 Pelagatti ..... E05F 11/382 74/89.18
(Continued)

FOREIGN PATENT DOCUMENTS

DE 2653106 A1 * 5/1978 ..... E05C 17/32
DE 31 40 039 4/1983
(Continued)

OTHER PUBLICATIONS

International Search Report, PCT/EP2018/075668, dated Nov. 29, 2018.
Written Opinion, PCT/EP2018/075668, dated Nov. 29, 2018.

*Primary Examiner* — Chuck Y Mah
(74) *Attorney, Agent, or Firm* — Nixon & Vanderhye

(57) ABSTRACT

Mechanism for opening of a flap door of an item of furniture, including a part extensible telescopically under the action of a spring, hinged to a lateral side of an item of furniture and acting on a door by way of a thrust fulcrum, wherein a unit is provided, apt to move continuously the thrust fulcrum during the phases of opening and closure of the door.

18 Claims, 14 Drawing Sheets

(58) Field of Classification Search
CPC ..... E05F 3/20; E05F 3/18; E05D 11/1021; E05D 3/12; E05D 3/14; E05D 3/16; E05D 15/40; E05D 15/401; E05D 15/405; E05D 15/406; E05D 15/42; E05D 15/58; E05D 15/565; E05B 3/5045; E05Y 2800/122; E05Y 2800/22; E05Y 2900/20; E05Y 2900/202; E05Y 2900/208; E05Y 2900/21; E05Y 2201/21; E05Y 2201/264; E05Y 2201/212; E05Y 2201/604; E05Y 2201/722
See application file for complete search history.

(56) References Cited

U.S. PATENT DOCUMENTS 4,383,347 A * 5/1983 La Conte ..... B64D 11/003 16/360
4,452,015 A * 6/1984 Jacques ..... E05F 1/1091 49/344
4,658,473 A * 4/1987 Schema ..... E05F 1/1261 16/286
5,882,099 A * 3/1999 Salice ..... E05D 15/262 312/328
5,896,619 A * 4/1999 Koopman ..... E05F 1/1253 16/50
7,168,477 B2 * 1/2007 Salice ..... E05D 15/262 160/213
8,482,906 B2 * 7/2013 Farley, Jr. ..... E05F 1/1091 361/679.01
8,572,811 B2 * 11/2013 Lautenschlager .... A47B 88/473 16/370
8,894,162 B2 * 11/2014 Kashiwaguma ..... E05F 1/1058 312/319.2
2001/0039762 A1 * 11/2001 Giovannetti ..... E05F 1/1091 49/246
2002/0108311 A1 * 8/2002 Salice ..... E05F 1/1091 49/371
2010/0109497 A1 * 5/2010 Blersch ..... E05F 1/1253 312/405
2010/0281650 A1 * 11/2010 Kleemann ..... E05F 5/02 16/64
2012/0084944 A1 * 4/2012 Hirtsiefer ..... E05D 3/14 16/302

FOREIGN PATENT DOCUMENTS

DE 42 38 694 5/1994
DE 102 03 269 8/2003
DE 102004019785 A1 * 11/2005 ..... E05D 15/46
DE 202014104301 U1 * 12/2015 ..... E05D 15/463
EP 2 078 811 7/2009
WO WO 2006/012848 2/2006

* cited by examiner

AUTOMATIC OPENING MECHANISM FOR FLAP DOORS

BACKGROUND OF THE INVENTION

Field of the Invention

The object of the present invention is a mechanism for automatic opening for flap doors of a kitchen, bathroom, living area item of furniture or of any item of furniture in general.

Particular reference will be made here below to doors with a lift opening, without detriment to the fact that the mechanism according to the invention can also be applied to downward flap doors.

Description of the Related Art

Automatic opening mechanisms of flap doors use normally gas springs, wherein a gas cylinder and the relative stem are connected directly between a lateral side of the item of furniture and the door to be moved.

Gas springs, although having acceptable functioning, are not free from disadvantages.

They tend in fact to unload with the passing of time, losing their original properties and not therefore performing their task in full.

Another disadvantage of gas springs is that they do not allow sufficient partialization of the degree of opening of the door, which may become necessary or useful in certain circumstances.

Another disadvantage comes from the unsightly appearance, since these are cylindrical tubular elements that are attached directly between the lateral side of the item of furniture and the door.

Moreover, gas springs have a somewhat high cost.

On the other hand, a mechanical spring of another type, whether helical, leaf spring or the like, would not be suitable for this type of opening, in that it would not allow a linear or uniform thrust during opening. More particularly, in the case of a lift flap door, when the door is closed the spring is in its state of maximum compression, so that when the door is opened there is a maximum thrust force which is reduced gradually until complete opening.

DE 10203269 A1, EP 2078811 A2 and WO 2006/012848 A1 are examples of mechanisms for opening of flap doors upwards using gas springs.

DE 3140039 A1 describes a mechanism for balancing of the weight of a door of an electric household appliance, more particularly a dishwasher, with hinge opening around a fixed axis of a sector gear with which a corresponding sector gear meshes, provided at one end of a lever pivoted in one of its intermediate points and connected at its other end to an oscillating compression springs assembly.

SUMMARY OF THE INVENTION

The object of the present invention is that of providing a mechanism for opening of flap doors which is proposed as an alternative to gas springs, eliminating the disadvantages thereof, and likewise eliminating the disadvantages of the mechanical spring mechanisms illustrated previously.

More particularly one object of the invention is that of proposing a mechanical spring mechanism which allows the movement of opening of the door to be linearised, making the thrust of the spring during the entire opening stroke virtually uniform.

Another object of the invention is that of providing such a mechanism which assists also in the phase of closure of the door and avoids a sudden release in the opening phase.

Yet another object of the invention is that of providing such a mechanism which is simple and economical to produce and easy to assemble and mount.

Substantially, the mechanism for flap opening of a door connected to an upper or lower wall of an item of furniture by means of at least one hinge, comprises a part fixed internally to a lateral side of the item of furniture and a part fixed internally to the door, said part fixed to the lateral side being extensible telescopically under the action of a mechanical spring and having a first end hinged to said lateral side of the item of furniture and acting with a second end on said part fixed to the door by means of a thrust fulcrum, characterised in that between said part fixed to the lateral side and said part fixed to the door means are provided apt to move linearly and continuously said thrust fulcrum parallel to the door, away from and towards said hinge, respectively during the phase of opening and closing of the door.

BRIEF DESCRIPTION OF THE DRAWINGS

Further features of the invention will be made clearer by the following detailed description, referred to one of its embodiments purely by way of a non-limiting example, illustrated in the accompanying drawings, in which.

DESCRIPTION OF THE PREFERRED EMBODIMENTS

Figure 1A:
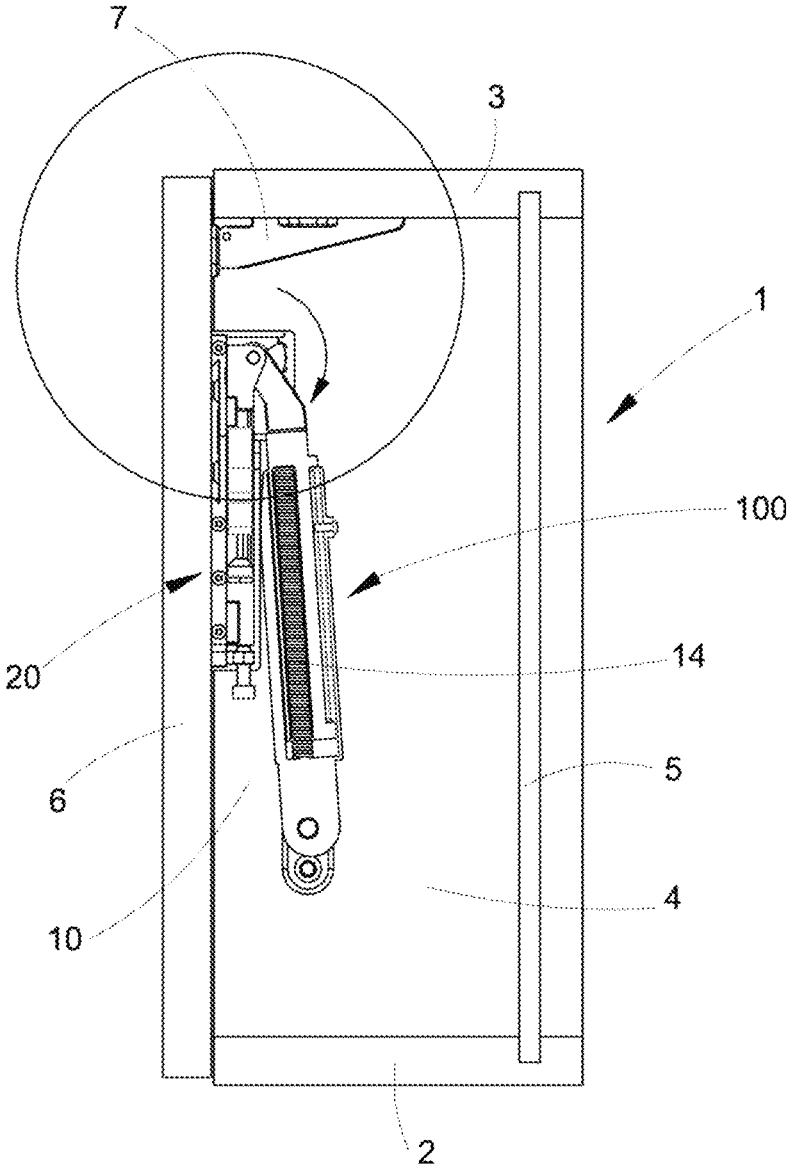
FIG. 1 shows schematically an item of furniture with flap door which can be opened upwards, provided with a mechanism according to a first embodiment of the invention shown in the condition of door closed.
FIG. 1*b* is an enlarged view of the detail enclosed in a circle in FIG. 1*a;*
FIG. 1*c* is an enlarged view showing in detail the part of mechanism of FIG. 1*a* applied to the door.
Figure 1B:
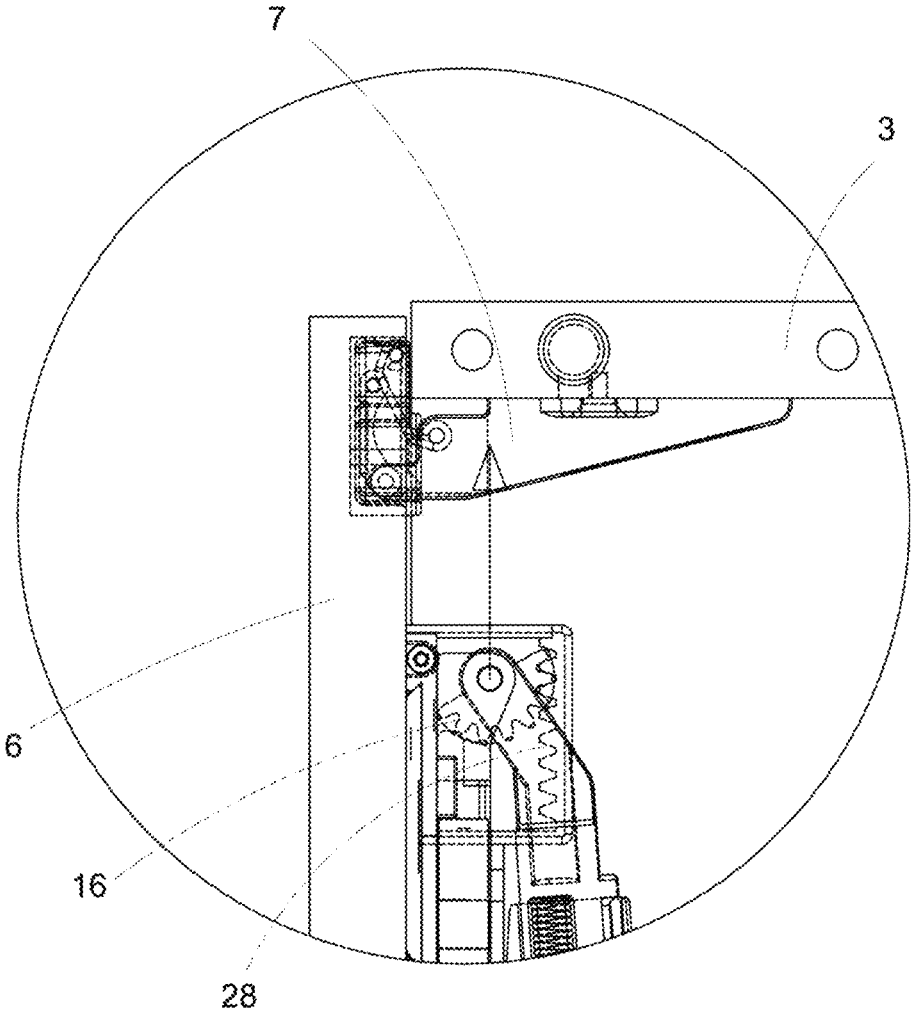
Figure 1C:
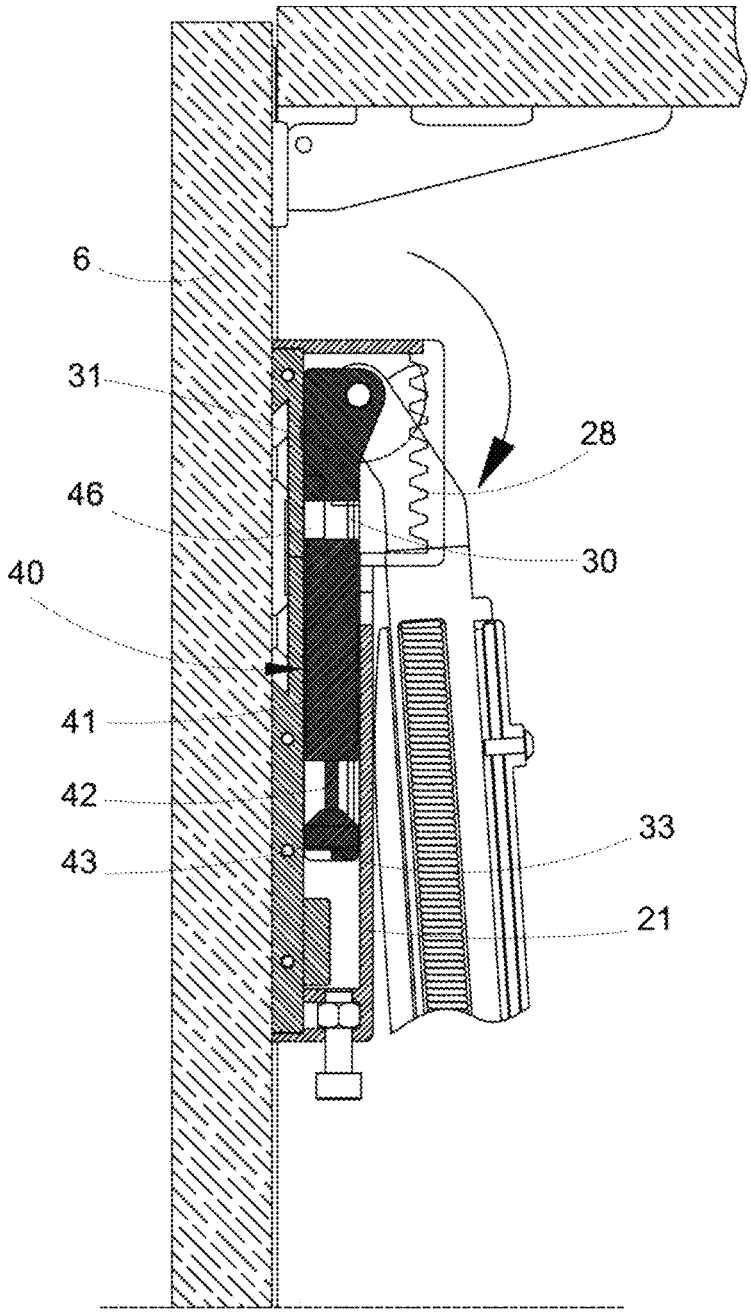
Figure 2A:
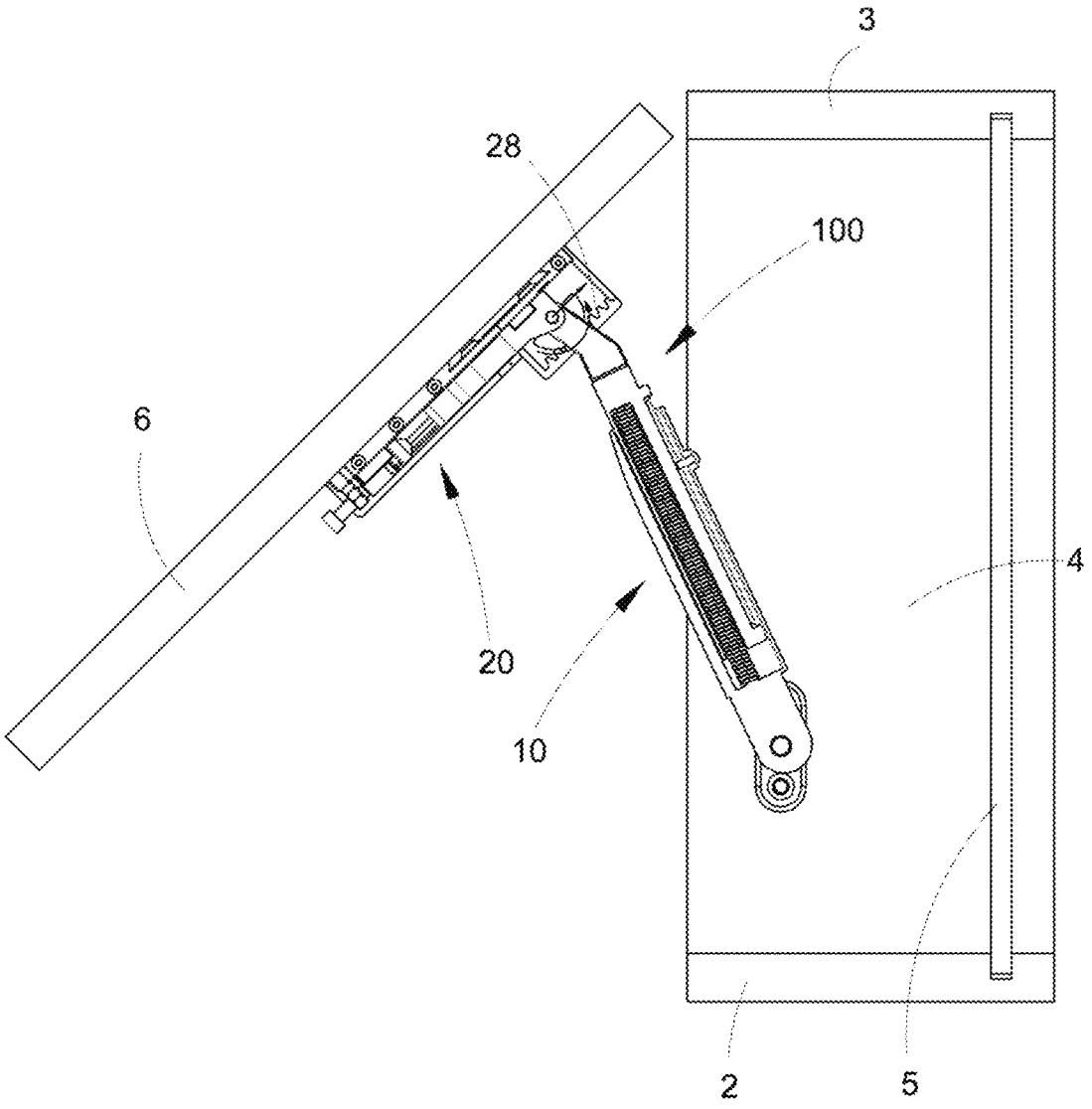
FIGS. 2*a*, 2*b*, 2*c* are views like those of FIGS. 1*a*, 1*b*, 1*c*, respectively, in a condition of intermediate opening of the door.
Figure 2B:
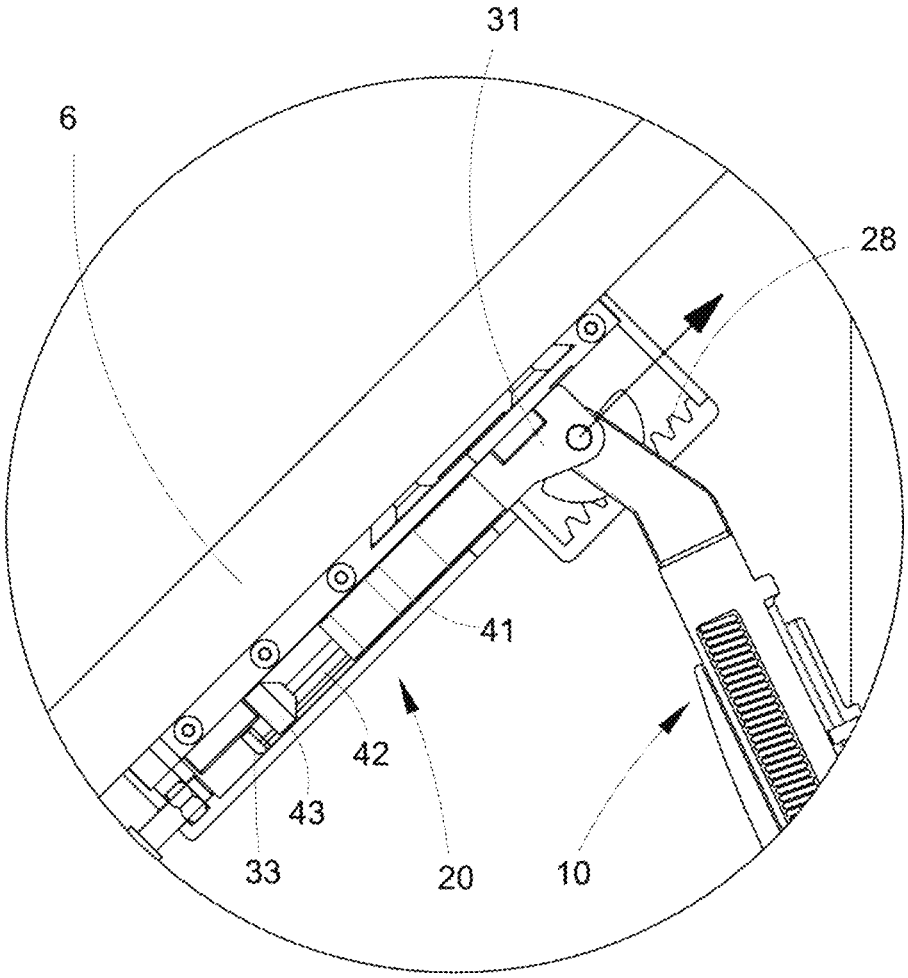
Figure 2C:
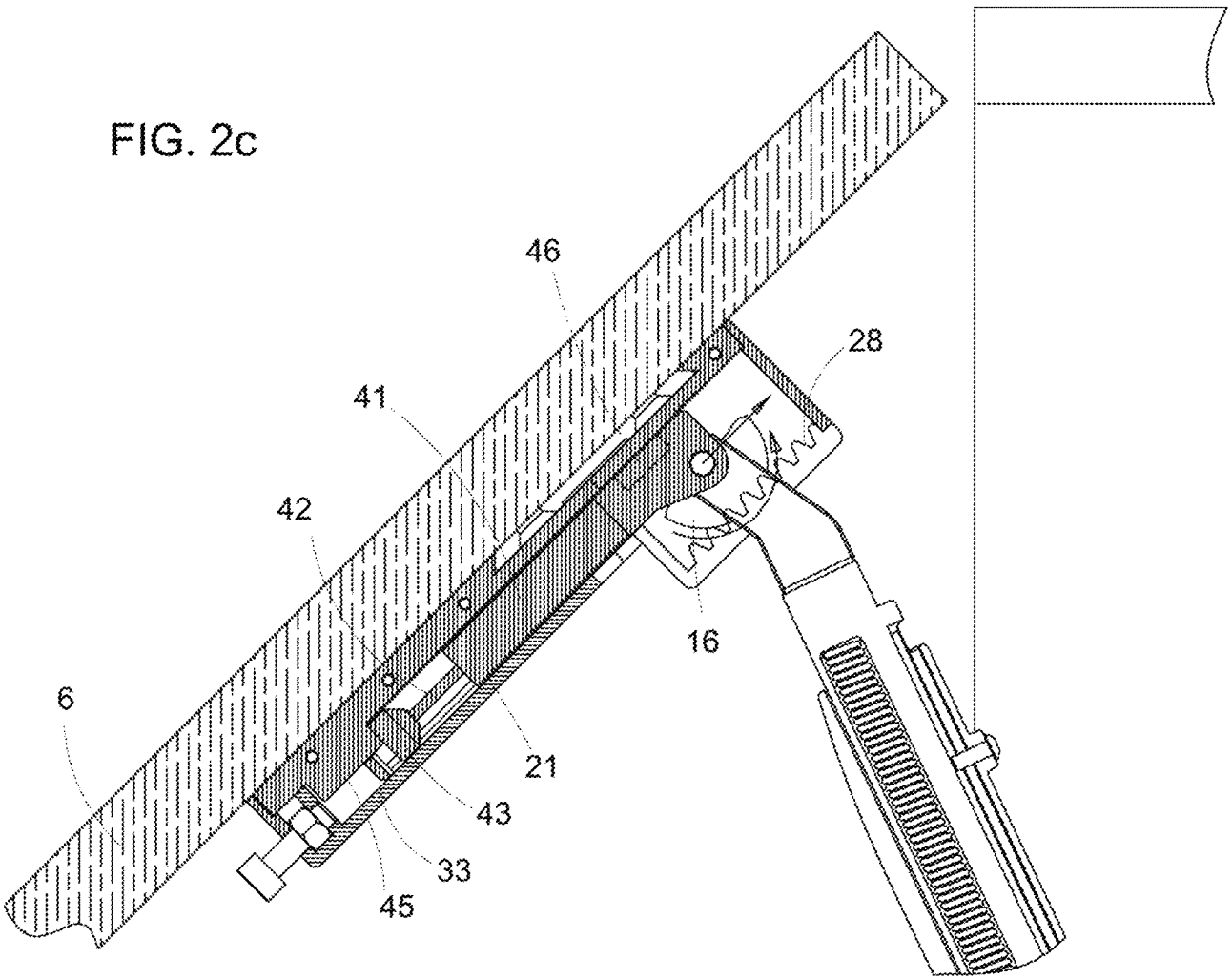
Figure 3A:
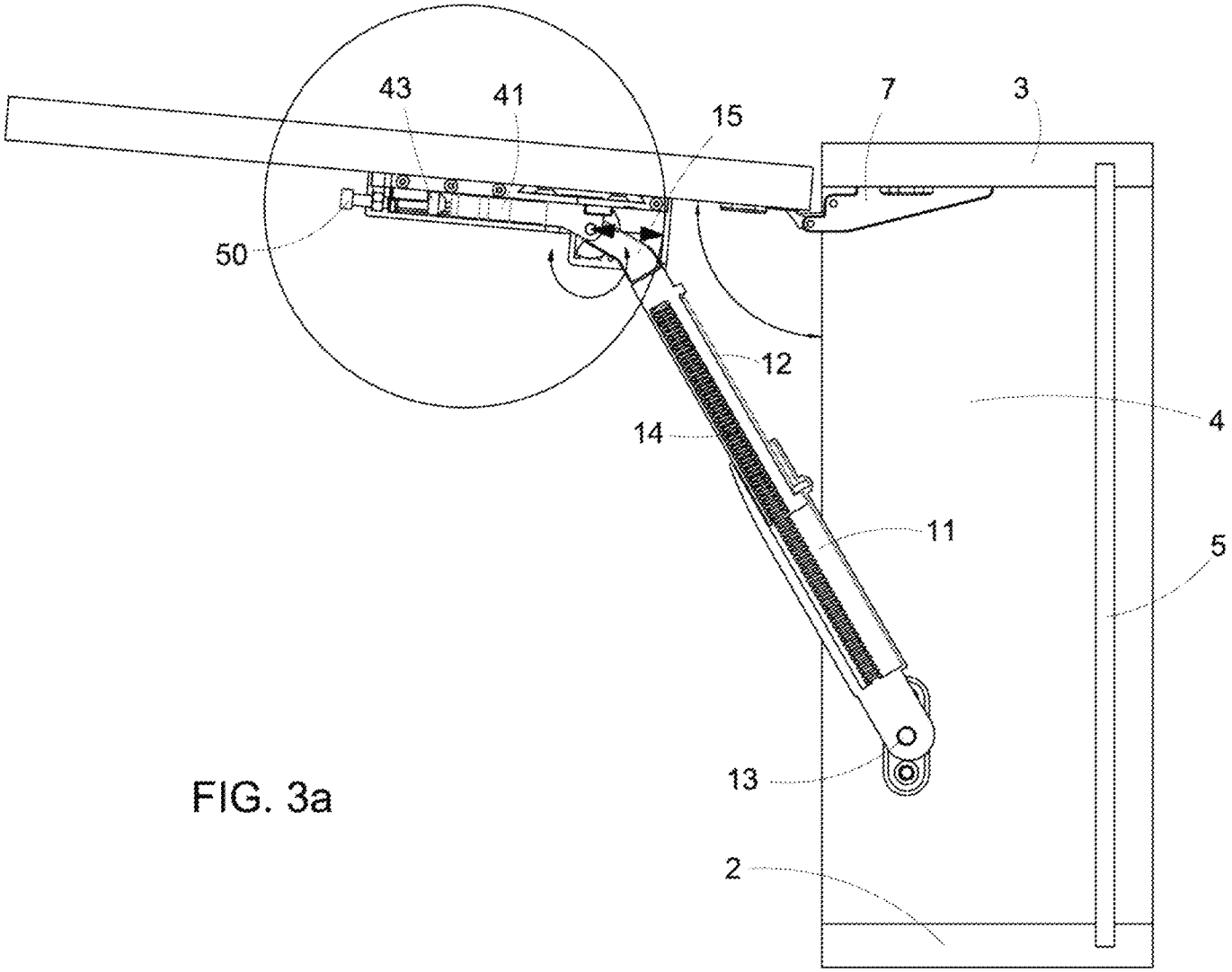
FIGS. 3*a*, 3*b*, 3*c* are views like those of FIGS. 1*a*, 1*b*, 1*c*, respectively, in a condition of complete opening of the door.

Referring to FIGS. 1 to 5, and for the time being in particular to FIGS. 1*a*, 2*a* and 3*a*, they illustrate an item of furniture, denoted overall by reference numeral 1, comprising a fixed frame made up of a lower shelf or wall 2, an upper shelf or wall 3, two side walls or lateral sides 4, one of which removed to show the mechanism according to a first embodiment of the invention, denoted by reference numeral 100, and a possible back wall 5. The item of furniture 1 has frontally a flap door 6, which in the case in question is of the lift openable type and, in lowered position (FIG. 1), closes an internal compartment of the furniture item.

Some of these drawings show also a hinge 7, in itself known, which connects the door 6 to the upper wall 3 of the furniture item.

Normally more than one hinge 7 is provided, while the opening mechanism 100 can be only one or more than one, according to the width of the door.

The mechanism 100 comprises a part 10 fixed internally to a lateral side 4 of the furniture item 1 and a part 20 fixed internally to the door 6, co-operating one in relation to the other in the manner to be stated here below.

More particularly the part 10 is made up of two telescopic tubular rods, one lower 11, with reference to the accompanying drawings, hinged in 13 to the lateral side 4 of the furniture item, and an upper one 12 sliding telescopically inside thereof. Between the two tubular rods 11 and 12 a helical spring 14 is placed, working in compression and tending to push outwards, or upwards, the upper tubular rod 12.

The mechanism part 20 fixed to the door 1 comprises a box 21 closed by a cover 22 by means of screws 23, and enclosing in its interior the components which are to be described here below.

The box-cover assembly is fixed to the door 6 by means of a dovetail seat 24 formed in the cover 22 which engages slidingly with a corresponding plate 25 fixed to the door 6.

Naturally other attachment means are possible.

The box 21 has an elongated parallelepiped shape, with an initial section 26, closer to the hinge 7, of greater depth and open on the base, so as to determine two opposite lateral walls 27, between which is arranged the end 15 of the upper tubular rod 12 of the telescopic part 10 fixed to the lateral side 4 of the furniture item.

The end 15 of the rod 12 has a fork configuration and has a pair of gears or sector gears 16, which go to engage with corresponding racks 28 provided on said lateral walls 27 of the box 21.

Here below, for the sake of convenience, the gears 16 and the racks 27 are to be indicated in the singular.

Figure 3B:
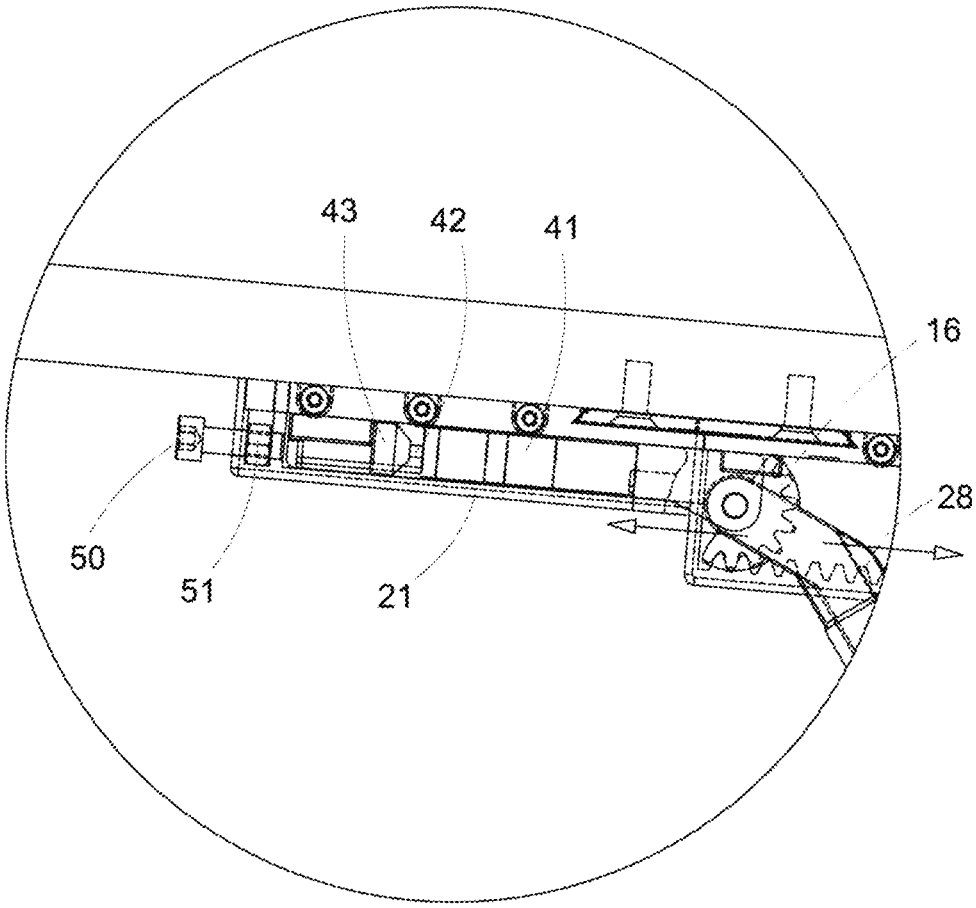
Figure 3C:
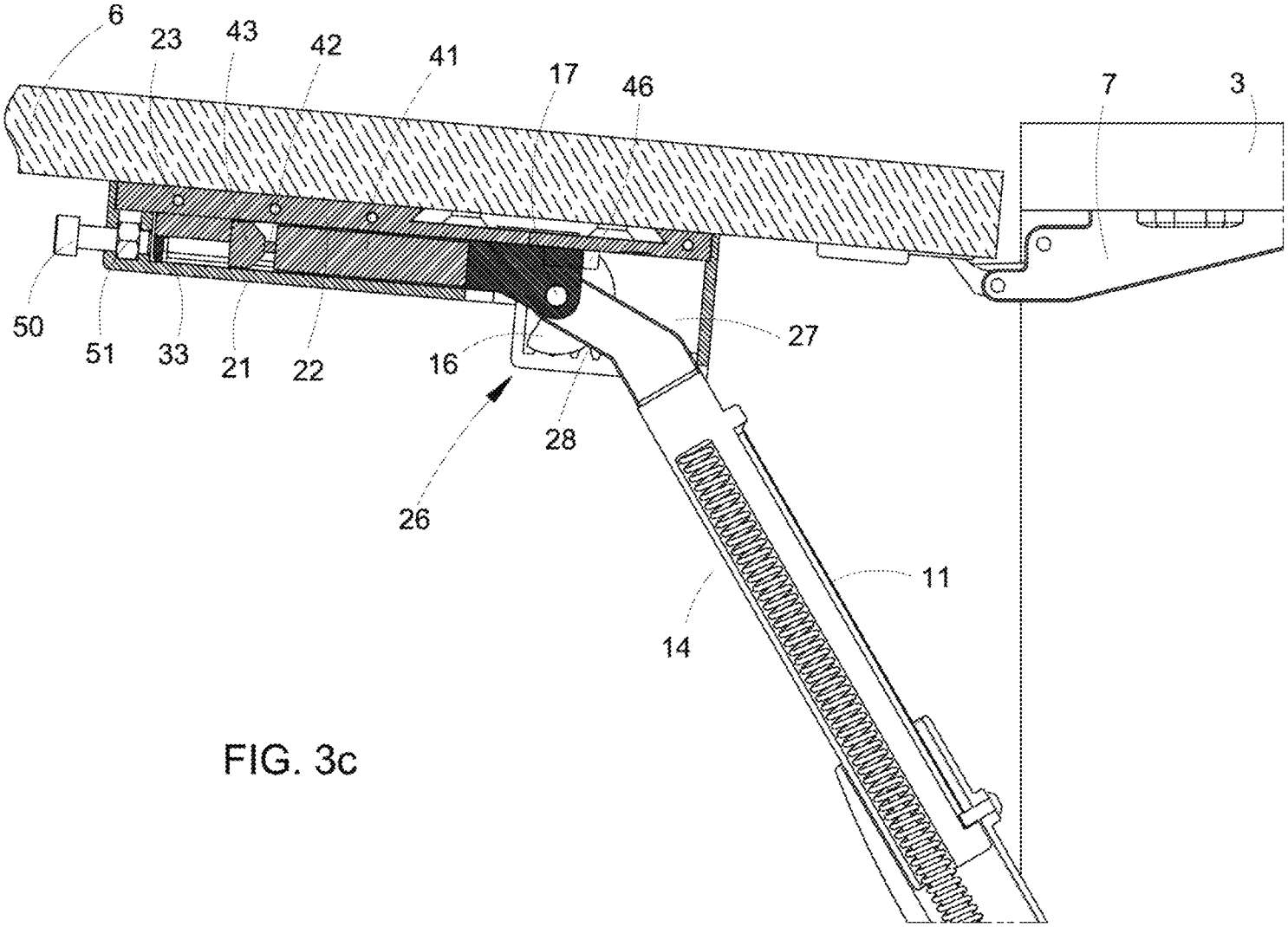
Figure 4:
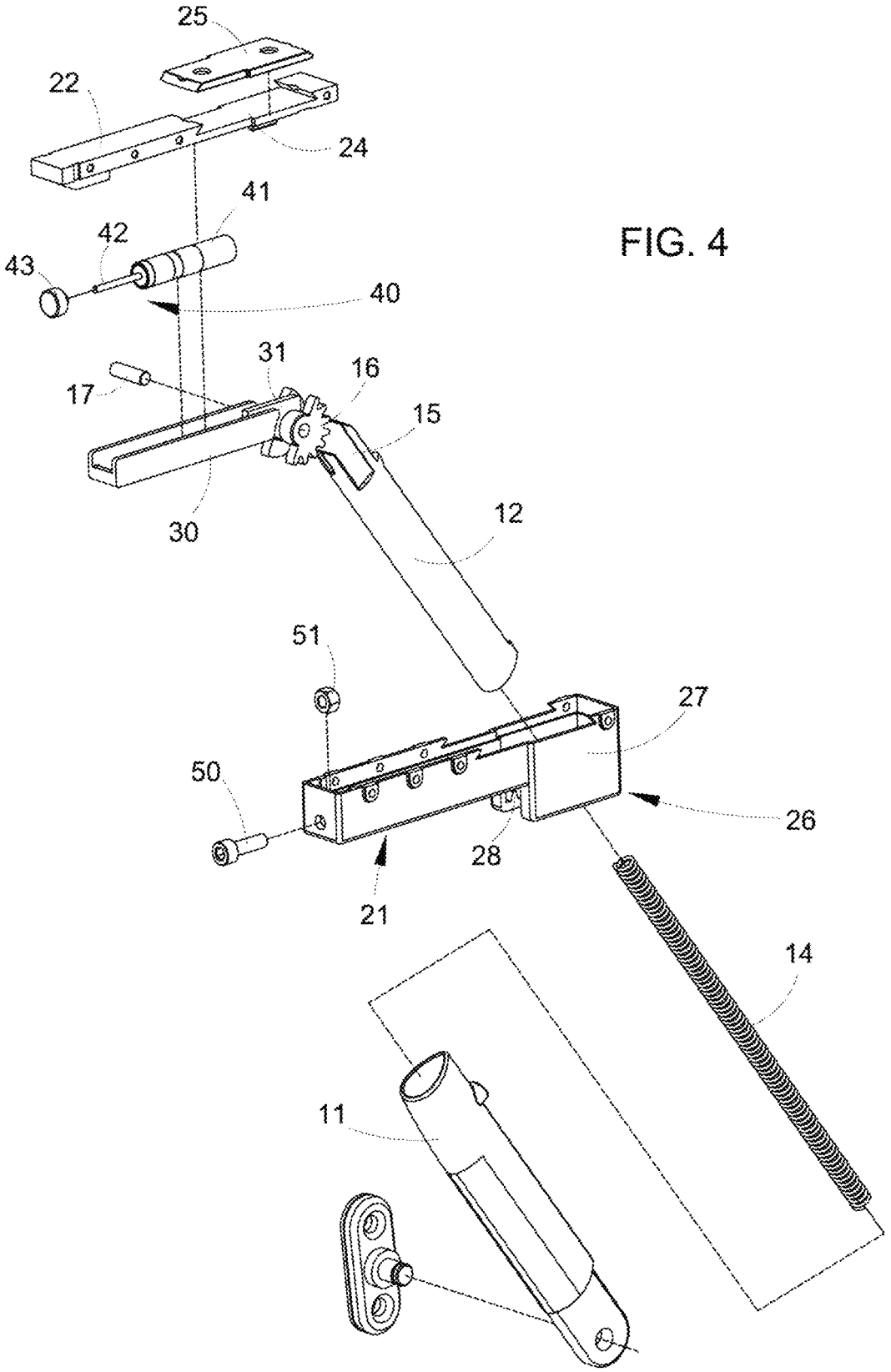
FIG. 4 is a blown-up axonometric view of the opening mechanism for flap doors of the previous figures.
Figure 5:
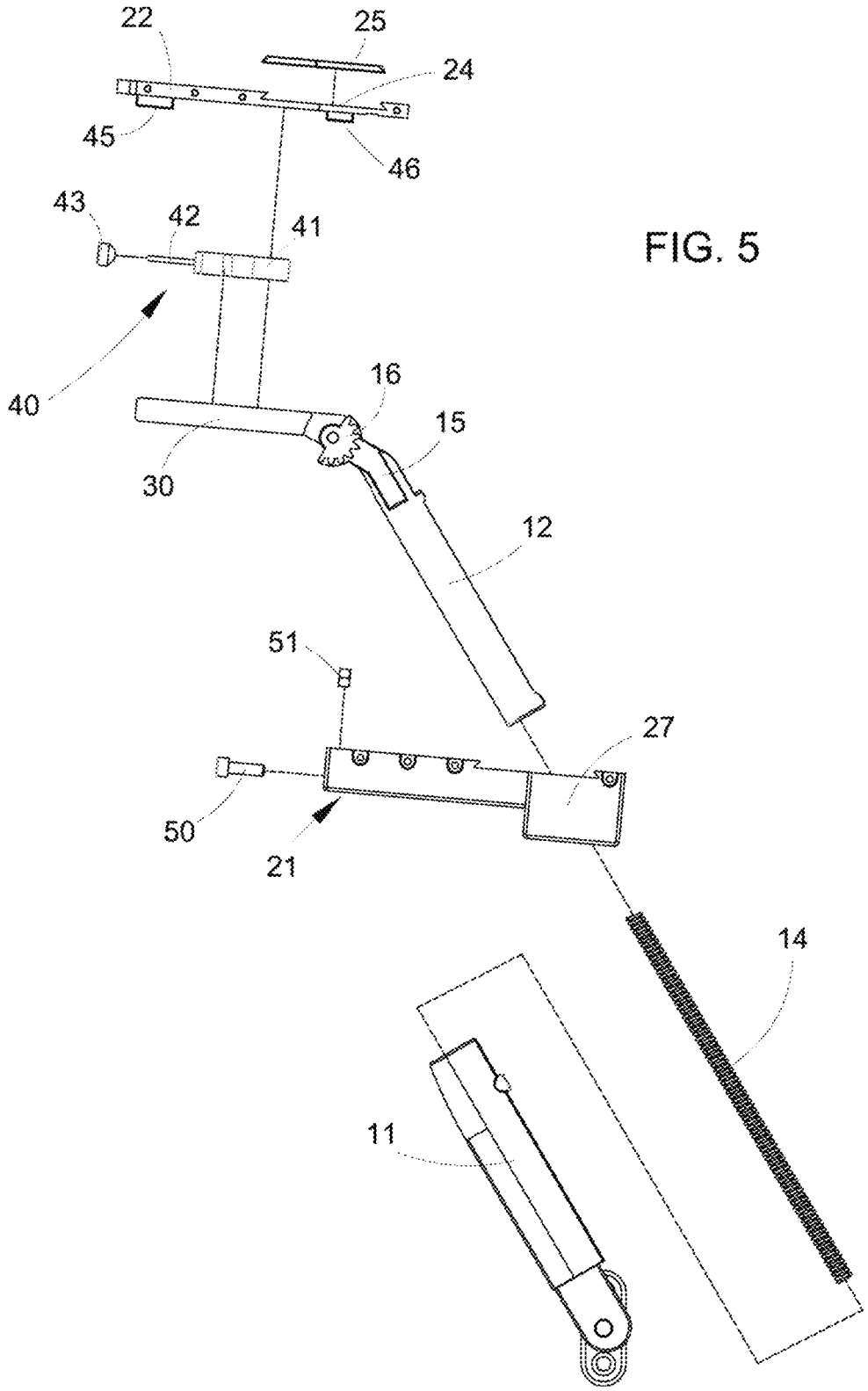
FIG. 5 is a blown-up side view of the mechanism of FIG. 4.

The provision of a gear-rack coupling determines a variable fulcrum point during the opening of the door, as shown in particular in FIGS. 1*c*, 2*c*, 3*c*, which allows the thrust action of the spring to be made uniform, and therefore to make the movement of opening of the door linear.

In fact, passing from the position of FIG. 1 to the position of FIG. 3, the fulcrum 17 of thrust on the door, on which the gear or sector gear 16 is centred, moves linearly and parallel to the door away from the hinge 7, making the lever arm increase and in this way compensating the reduction in the thrust force of the spring 14 as it relaxes.

In order to improve further the functioning of the spring mechanism according to the invention, damping is provided in the phase of opening and closure of the door 6, which will be described here below.

More particularly, a sliding drawer 30 is housed in the box 21, having frontally a protuberance 31, to which is pivoted by means of a pin 17 the end 15 provided with gear 16 of the hollow rod 12.

In the drawer 30 a shock absorber or damper 40 is placed, made up of an oil cylinder 41, from which a stem 42 with tip 43 protrudes.

During the movement of the drawer 30 in the phase of opening and closure of the door 16, the damper 40 abuts alternatively against respective stops 45, 46 projecting below from the cover 22.

More particularly, in the phase of opening of the door, the engaging between the gear 16 and the rack 28 moves the drawer 30 away from the hinge 7, until the aforesaid protuberance 31 abuts against the cylinder 41, drawing it in its movement and causing the loading thereof, through the action of the tip 43 of the stem 42 which abuts against the stop 45 of the cover 22.

The stroke of the drawer 30 is determined by a regulation screw 50, against which its rear wall 33 abuts.

The regulation screw 50 is screwed in a nut 51 housed in the box 21 and, on the basis of the extent of penetration of its shank in the box 21, varies the stroke of the drawer and therefore the degree of opening of the door 6.

As can be seen in FIG. 3*c*, the damper 40 is loaded to the maximum, with the stem 42 returning almost entirely into the cylinder 41. Therefore, in the final phase of opening of the door 6 there is a damping effect on the same.

In the phase of closure of the door, while the drawer 30 moves towards the hinge 7, the damper 40 tends to unload, abutting with the cylinder 40 against the front stop 46 of the cover 22. Continuing the movement of the drawer 30, its rear wall 33 drives the tip 43 of the stem 42, causing a further loading of the damper, and therefore performing a damping effect also in the phase of closure.

The situation is fully visible in FIGS. 1*c*, 2*c* and 3*c*. In the condition of closed door of FIG. 1*c*, the damper is partially loaded, as can be seen from the projection of the stem 42 of the cylinder 41. In the condition of partial opening of FIG. 2*c*, the damper is unloaded and it is in the phase of start of loading, until being completely reloaded in the condition of FIG. 3*c*.

Naturally the extents of loading of the damper 40 in opening and closure can be appropriately regulated.

In the embodiment previously described and illustrated in the drawings, a gear and rack system has been provided for the movement of the fulcrum 17 in the phase of opening and closure of the door 6.

It is however evident that other systems can be provided, such as levers, cams and the like.

Figure 6A:
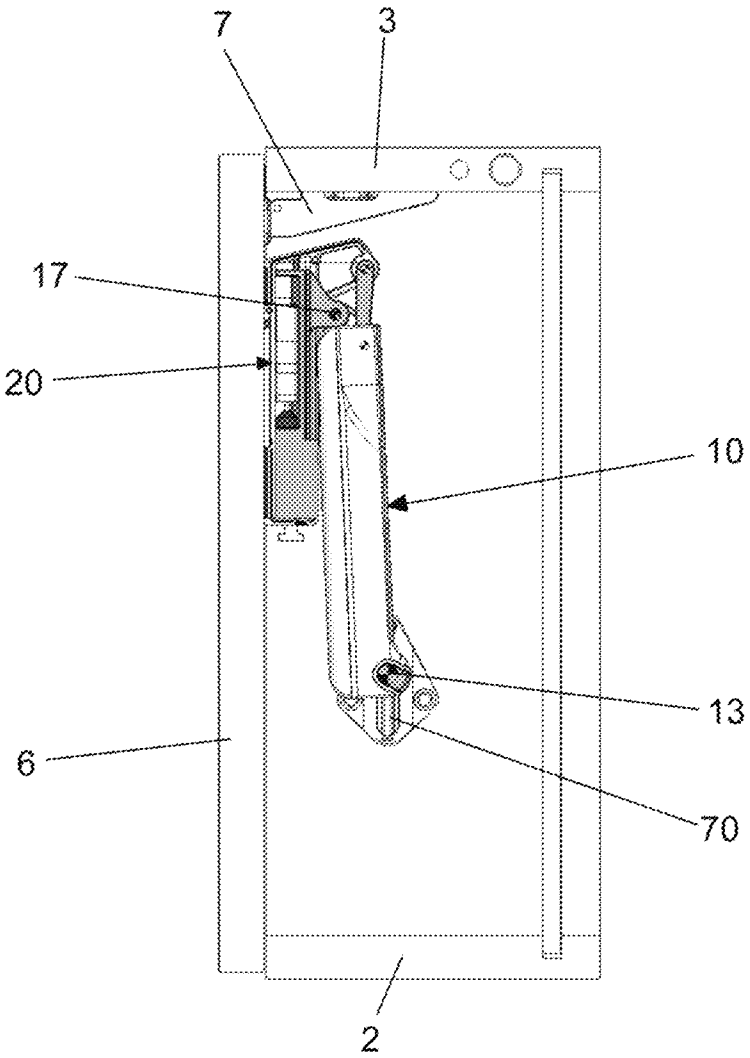
FIGS. 6*a*, 6*b*, 6*c* show a second embodiment of the mechanism according to the invention, respectively in the condition of door closed, of intermediate opening of the door and of door completely open.
Figure 6B:
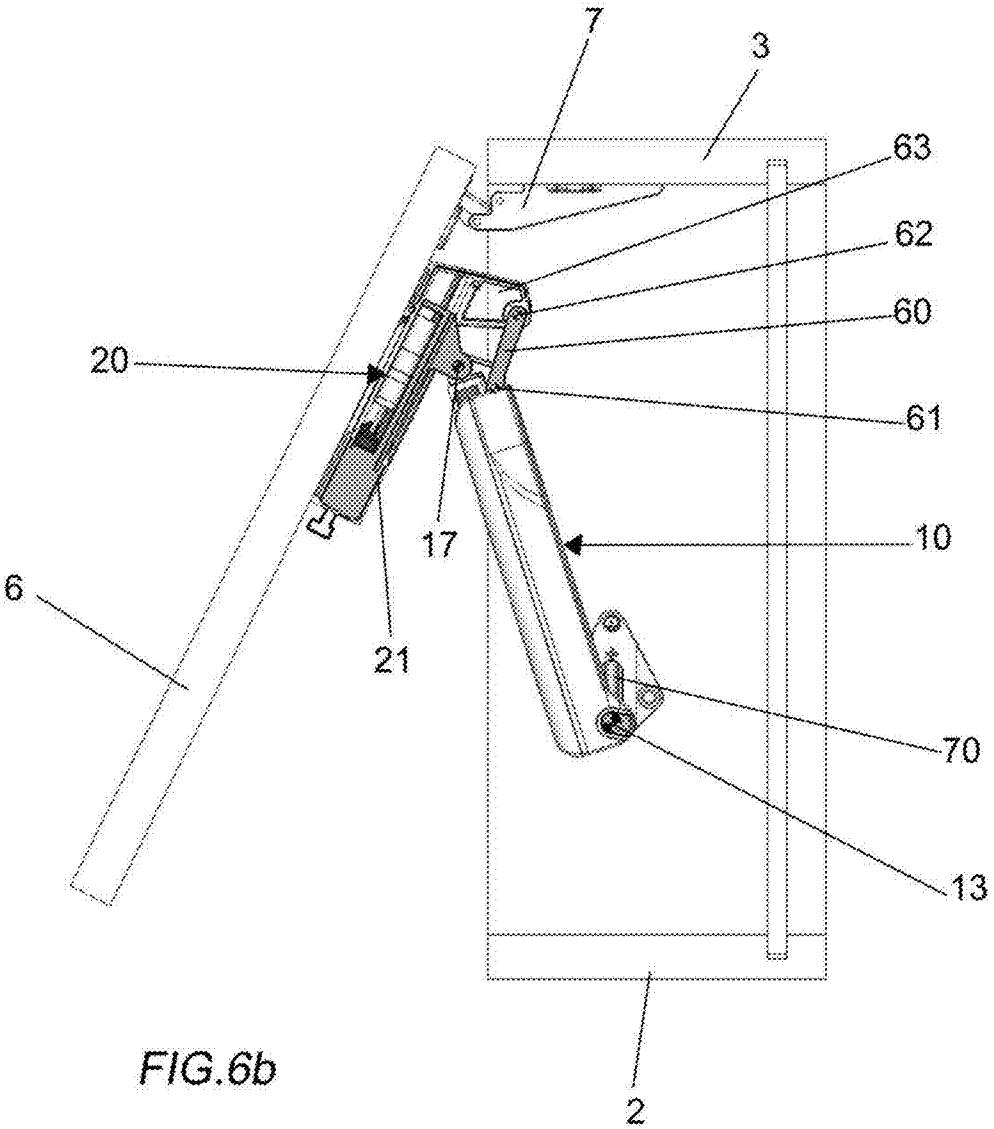
Figure 6C:
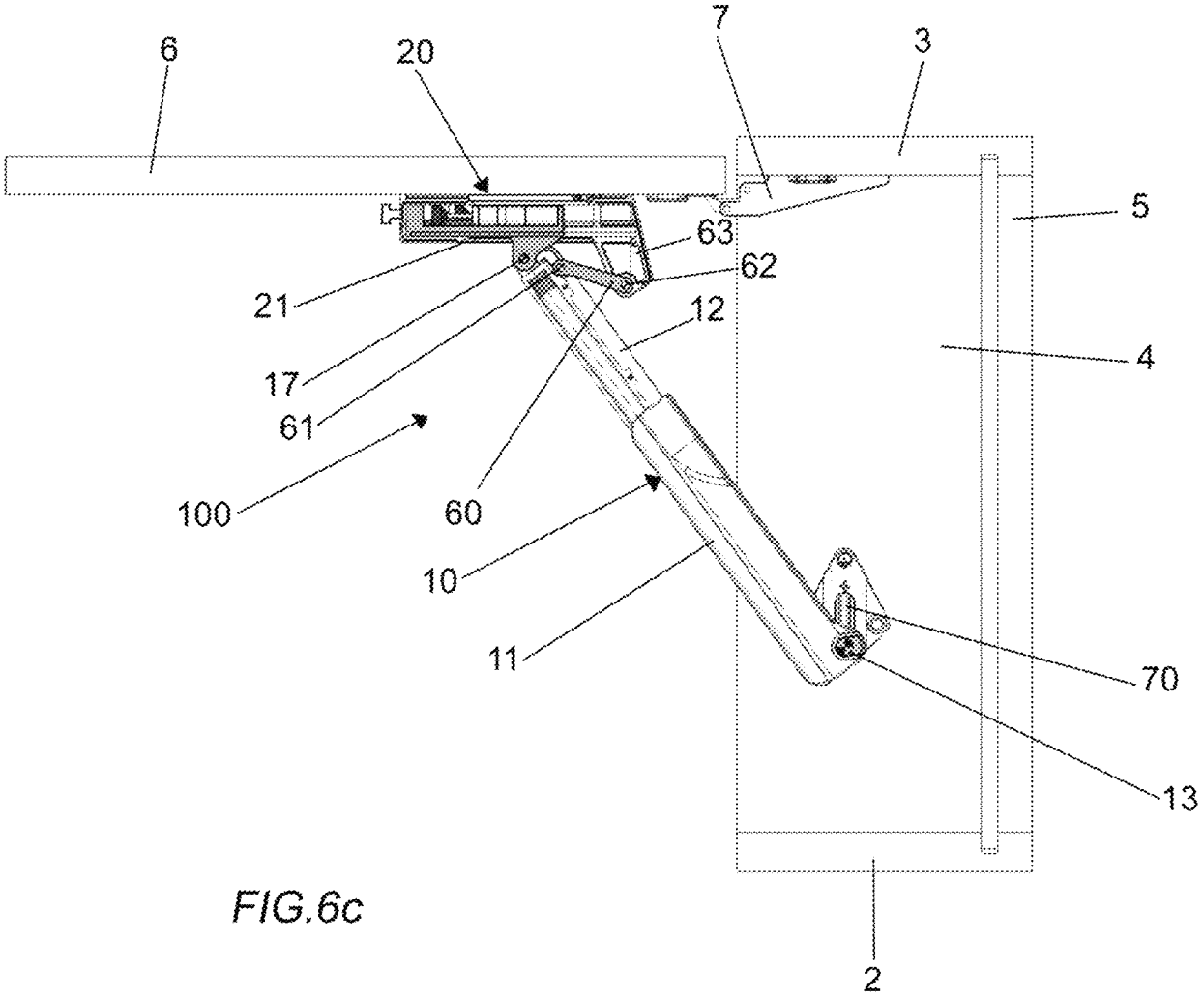

FIGS. 6*a*, 6*b*, 6*c* show a possible alternative embodiment of the means for the movement of the fulcrum 17 during the phases of opening and closure of the door, with a mechanism which is substantially identical to that of the previous embodiment, so that it will not be described again.

According to this embodiment, the means placed between the part 10 fixed to a lateral side 4 of the furniture item and the part 20 fixed to the door 6 consist of a lever 60, one of whose ends is pivoted in 61 to the end of said telescopically extensible part 10 hinged to a lateral side 4 of the item of furniture, and whose other end is pivoted in 62 to a projecting end 63 of the box 21 of the part 20 fixed to the door 6.

The rotation of the lever 60 of fixed length around the pivot pin 61 during the movements of opening and closure of the door 6 produces a movement of the thrust fulcrum 17 provided on the sliding drawer 30, in the same way as the embodiment described previously.

FIGS. 6*a-c* also show a screw 70 for regulation of the fulcrum 13 of the telescopic part 10, and therefore of the force of the spring, which can naturally be provided also in the first embodiment.

As mentioned previously, the mechanism for opening of a flap door according to the invention can be applied without substantial modifications also to the case of doors which can be opened downwards, simply by providing for the spring 14 to work by traction rather than by compression.

The components of the mechanism according to the invention can be in metal material or in rigid plastic or mixed.

Advantageously, at least the tubular rods 11, 12, the box 21 and the cover 22 are made in rigid plastic.

In the embodiment illustrated the spring 14 is of the helical type, yet it could be of another type, for example leaf spring, compression spring or the like.

From what is disclosed, the advantages appear clear of the invention, which allows the linearization of the action of the spring 14 by varying linearly and continuously the position of the thrust fulcrum 17 away from and towards the hinge 7 of connection of the door 6 to the furniture item 1, and partialization of the degree of opening of the door, regulating the stroke of the drawer 30, and damping the door both in opening and in closure.

Naturally the invention is not limited to the particular embodiment described previously and illustrated in the accompanying drawings, but numerous detail changes may be made thereto, within the reach of the person skilled in the art, without thereby departing from the scope of the same invention, as defined in the appended claims.

The invention claimed is:

1. Mechanism (100) for flap opening of a door (6) connected to an upper (3) or lower (2) wall of an item of furniture (1) by means of at least one hinge (7), comprising a part (10) fixed internally to a lateral side (4) of the item of furniture (1) and a part (20) fixed internally to the door (6), said part (10) fixed to the lateral side (4) being extensible telescopically under the action of a mechanical spring (14) and having a first end hinged in a fulcrum (13) to said lateral side (4) of the item of furniture (1) and acting with a second end on said part (20) fixed to the door (6) by means of a thrust fulcrum (17), wherein between said part (10) fixed to the lateral side (4) and said part (20) fixed to the door (6) means are provided apt to move linearly and continuously said thrust fulcrum (17) parallel to the door, away from and towards said hinge (7) respectively during the phase of opening and closing of the door, wherein said thrust fulcrum (17) is provided on a drawer (30) sliding in a box (21) of said part (20) fixed internally to the door (6), and wherein said means apt to move said thrust fulcrum (17) of the door comprise a lever (60), one of whose ends is pivoted to said second end of said telescopically extensible part (10) hinged to a lateral side (4) of the item of furniture (1), and whose other end is pivoted to said box (21) of said part (20) fixed internally to the door (6).

2. Mechanism (100) according to claim 1, wherein said box (21) is fixed to the door (6) by means of a closure cover (22).

3. Mechanism (100) according to claim 2, further comprising a damper (40), placed in said drawer (30) of said part (20) fixed to the door (6), apt to perform a damping effect during the phase of opening and closing of the door.

4. Mechanism (100) according to claim 2, wherein said door (6) can be flap-opened upwards and said spring (14) is a compression spring.

5. Mechanism (100) according to claim 2, wherein means (50) are provided apt to vary the stroke of said sliding drawer (30) in order to regulate the degree of opening of the door.

6. Mechanism (100) according to claim 5, further comprising a damper (40), placed in said drawer (30) of said part (20) fixed to the door (6), apt to perform a damping effect during the phase of opening and closing of the door.

7. Mechanism (100) according to claim 5, wherein said door (6) can be flap-opened upwards and said spring (14) is a compression spring.

8. Mechanism (100) according to claim 1, further comprising a damper (40), placed in said drawer (30) of said part (20) fixed to the door (6), apt to perform a damping effect during the phase of opening and closing of the door.

9. Mechanism (100) according to claim 8, wherein said door (6) can be flap-opened upwards and said spring (14) is a compression spring.

10. Mechanism (100) according to claim 8, wherein said damper (40) comprises a cylinder (41) from which a stem (42) with tip (43) protrudes, said tip (43) and said cylinder (41) abutting against respective stops (45), (46) protruding internally from a cover of said box (22) during, respectively, the opening and closing movements of the door.

11. Mechanism (100) according to claim 10, wherein said door (6) can be flap-opened upwards and said spring (14) is a compression spring.

12. Mechanism (100) according to claim 1, wherein said door (6) can be flap-opened upwards and said spring (14) is a compression spring.

13. Mechanism (100) according to claim 1, wherein said door (6) can be flap-opened downwards and said spring (14) is a traction spring.

14. Mechanism (100) according to claim 1, further comprising means (70) for regulation of the fulcrum (13) of said telescopically extensible part (10) and therefore of the force of the spring (14).

15. Mechanism (100) for flap opening of a door (6) connected to an upper (3) or lower (2) wall of an item of furniture (1) by means of at least one hinge (7), comprising a part (10) fixed internally to a lateral side (4) of the item of furniture (1) and a part (20) fixed internally to the door (6), said part (10) fixed to the lateral side (4) being extensible telescopically under the action of a mechanical spring (14) and having a first end hinged in a fulcrum (13) to said lateral side (4) of the item of furniture (1) and acting with a second end on said part (20) fixed to the door (6) by means of a thrust fulcrum (17), wherein between said part (10) fixed to the lateral side (4) and said part (20) fixed to the door (6) means are provided apt to move linearly and continuously said thrust fulcrum (17) parallel to the door, away from and towards said hinge (7) respectively during the phase of opening and closing of the door, wherein said thrust fulcrum (17) is provided on a drawer (30) sliding in a box (21) of said part (20) fixed internally to the door (6), and wherein said means apt to move said thrust fulcrum (17) of the door comprise a gear (16), centred on the thrust fulcrum (17), provided on said second end of said telescopically extensible part (10) hinged to a lateral side (4) of the item of furniture (1) and a rack (28) provided in said box (21) of said part (20) fixed internally to the door (6).

16. Mechanism (100) according to claim 15, wherein said box (21) is fixed to the door (6) by means of a closure cover (22).

17. Mechanism (100) according to claim 15, further comprising a damper (40), placed in said drawer (30) of said part (20) fixed to the door (6), apt to perform a damping effect during the phase of opening and closing of the door.

18. Mechanism (100) according to claim 15, wherein said door (6) can be flap-opened upwards and said spring (14) is a compression spring.

* * * * *